United States Patent [19]

Fariss, Jr.

[11] 4,061,168

[45] Dec. 6, 1977

[54] LOG SPLITTING DEVICE

[75] Inventor: James Douglas Fariss, Jr., Wilmington, Del.

[73] Assignee: Innovation Enterprises, Inc., Wilmington, Del.

[21] Appl. No.: 682,725

[22] Filed: May 3, 1976

[51] Int. Cl.[2] ..... B27L 7/00

[52] U.S. Cl. ..... 144/193 R; 144/193 C; 144/193 E; 254/95; 254/104

[58] Field of Search ..... 144/193 R, 193 A, 193 B, 144/193 C, 193 D, 193 E, 193 F, 193 H, 3 K; 254/95, 104

[56] References Cited

U.S. PATENT DOCUMENTS

| | | | |
|---|---|---|---|
| 85,009 | 12/1868 | Jackson | 144/193 R |
| 280,657 | 7/1883 | Mors et al. | 144/193 K |
| 1,191,176 | 7/1916 | Harber | 144/193 C |
| 1,209,262 | 12/1916 | Church | 254/104 |
| 3,185,442 | 5/1965 | Hemphill | 254/104 |

FOREIGN PATENT DOCUMENTS

| | | | |
|---|---|---|---|
| 1,006,575 | 1/1952 | France | 144/193 K |

*Primary Examiner*—Othell M. Simpson
*Assistant Examiner*—W. D. Bray

[57] ABSTRACT

This invention provides a useful and inexpensive log splitting device, especially suited for home use, comprising jack means having a platform block mounted upon the jacking mechanism and a wedge block mounted fixedly upon the jack post, wherein, when a log is placed between the platform block and the wedge block and the jack means are actuated, the log is split. In addition, there is provided a new and useful log splitting wedge.

3 Claims, 6 Drawing Figures

1
2
2a
2b
3
4
5
6
7
8
9
a
b
c
d
e
f

LOG SPLITTING DEVICE

This invention provides a device useful for splitting logs.

Many devices have previously been developed for splitting logs. Several of these devices utilize hydraulic mechanisms to force wedge means into and through logs, thereby, effecting splitting in a semi-automatic operation. See, for example, U.S. Pat. No. 3,280,864 (1966) and U.S. Pat. No. 3,760,854 (1973).

However, in spite of the many devices previously developed for log splitting, the most popular means for the homeowner today is still the use of a simple wedge and a heavy hammer, usually a 4-pound hammer, whereby the log to be split is stood on end, the apex of the wedge is placed at the top end of the log, and the wedge butt end is beaten upon with the hammer until splitting is effected.

This popular method is a laborious, unsafe and time-consuming manual operation.

The present invention provides a device for splitting logs and obviates all of the previous difficulties. The device is inexpensive, safe to operate, and is especially suited to home use.

The invention comprises jack means having a jack post and a jacking mechanism, a platform block mounted upon the jacking mechanism, and a wedge block fixedly mounted on the jack post, such that, when a log is placed between the platform block and the wedge block and the jack means are actuated, the log is split.

In addition, I have discovered a new and useful log splitting wedge which may be used in conjunction with the jacking mechanism described above, or which may be used in the conventional way.

The detailed features of this invention will be better understood through a discussion of the embodiments illustrated in the accompanying drawings.

BRIEF DESCRIPTION OF THE DRAWINGS

In the drawings, FIG. 1 is an overall perspective view of one embodiment of this invention showing platform block or base block 1 mounted upon jacking mechanism 4 and 5, and wedge block 2, mounted upon jack post 3.

FIG. 2 is a perspective view of wedge block 2 in which the aperture 8 is shown. Jack bar 3 is inserted through aperture 8 as shown in FIG. 1.

FIGS. 2*a* and 2*b* are perspective views of alternate embodiments of wedge block 2, designated 2*a* and 2*b* respectively, also showing aperture 8 through which jack bar 3 is inserted. Wedge block 2 is fixedly attached to jack bar 3. This attachment may be accomplished in many ways. For a permanent unit, wedge block 2 could be welded to jack bar 3. For a removeable unit, wedge block 2 could be fixed by means of a set screw through the base of wedge block 2 and tightened to contact jack bar 3 to fix its position. Specific means for fixedly attaching wedge block 2 to jack bar 3 are not shown in the drawings for convenience, since it is recognized that many methods may be used to accomplish this purpose. I deem all of these other methods to be equivalent to and included within the scope of my invention.

Figures 1, 2, 2A, 2B, 3, 4:
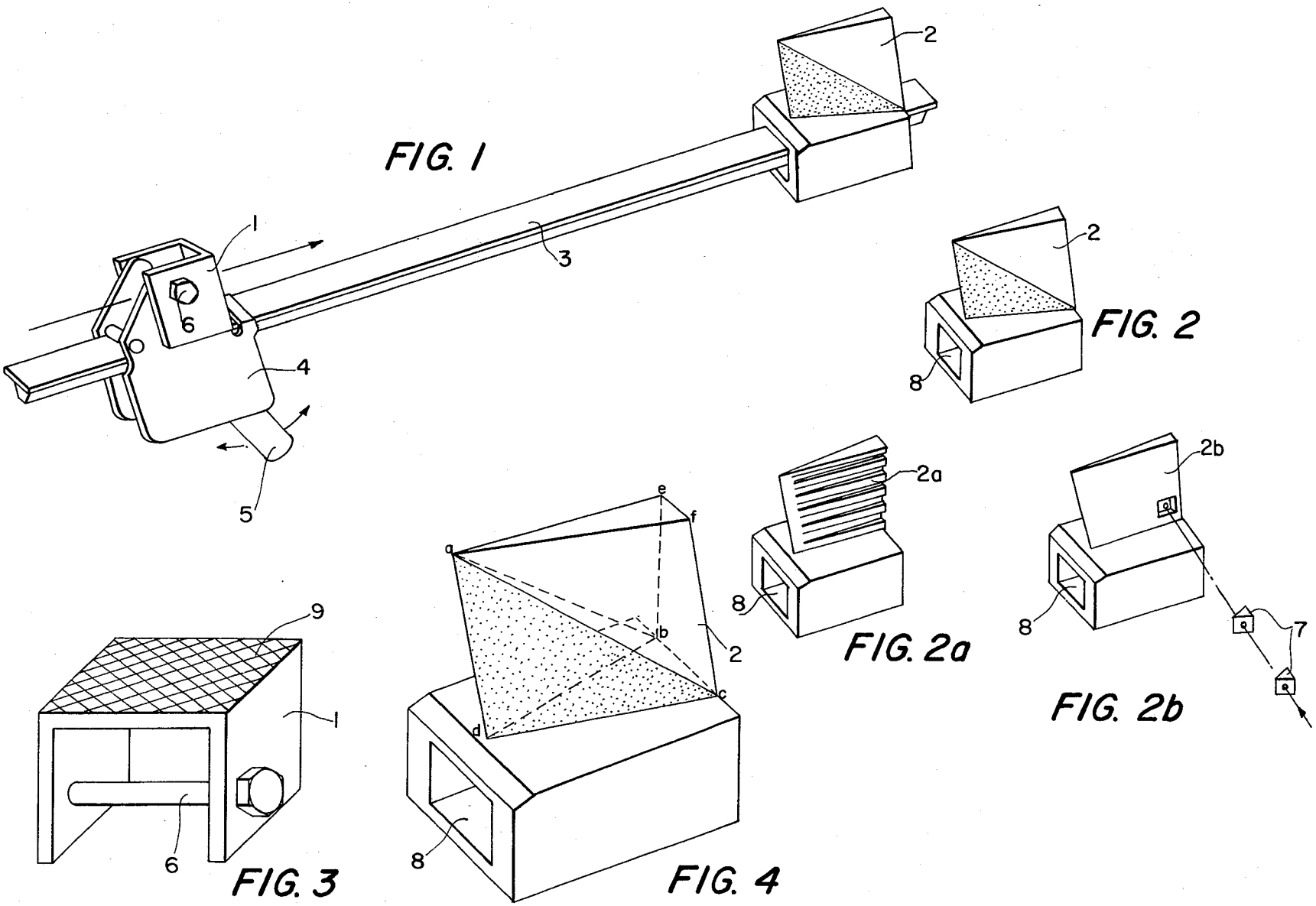
FIG. 1 is an overall perspective view of one embodiment of the invention.
FIG. 2 is a perspective view of, the wedge block shown in FIG. 1.
FIGS. 2*a* and 2*b* are perspective views of alternate embodiments of the wedge block.
FIG. 3 is a perspective view of the platform block shown in FIG. 1.

So also, only three alternate embodiments of wedge block 2 are shown in FIGS. 2, 2*a* and 2*b*.

It is recognized that other shapes of wedge block 2 could be utilized in cooperation with the jacking means as described. I deem all of these other wedges to be equivalent to and included within the scope of my invention.

FIG. 3 is a perspective view of platform block 1. Platform block 1 is fixed to the jacking mechanism 4 by means of bolt 6 shown in FIG. 3.

Also shown in FIG. 3, in a preferred embodiment, is a cross-hatched pattern of grooves 9 machined into the face of the platform block. The purpose of this cross-hatch pattern, or waffeling, is to fix the position of the log to be split in order to prevent lateral shifting of the log during splitting. It is recognized that this cross-hatching is not the only way to prevent lateral shifting of the log. Spikes or raised ridges, for example, on the face of platform block 1, would prevent log shifting, as well as many other means. I deem all of these other means, not shown in the drawings for convenience, to be equivalent to and included within the scope of my invention.

FIG. 2 shows a geometric wedge block 2 particularly suitable for splitting seasoned wood. Wedge block 2 is described more fully hereinbelow.

FIG. 2*a* shows wedge block 2*a* wherein grooves have been machined into the splitting faces of the wedge. These grooves serve to minimize the frictional drag of the wedge as it splits the log, and wedge block 2*a* is preferred when splitting fresh, wet wood.

FIG. 2*b* shows wedge block 2*b* wherein inserts 7 are provided to impart additional parting forces during the splitting operation.

More specifically, my invention is a device for splitting logs comprising jack means including a jack post and jacking mechanism, and a platform block mounted upon the jacking mechanism as shown in the drawings having a face to contact one end of a log to be split, with means provided on the face of said platform block to prevent lateral movement of the log, and a wedge block fixedly attached to the jack post, with wedge apex facing said platform block such that, when the jack means are actuated forcing the platform block toward the wedge block, the log placed between the blocks is split.

The jack means may be quite simple. In a preferred embodiment, the jack means utilized are simply a conventional automobile jack assembly. Clearly, more sophisticated jack means may be employed.

In a preferred embodiment, and for all splitting wedges, the angle formed by the wedge apex and the jack bar, when viewed as shown in FIG. 1, i.e. the angle facing the platform block, is acute. This acute angle provides means whereby the log to be split is prevented from disengaging at the wedge block end during the splitting process.

During conventional manual splitting of logs using wedge and hammer, it is not unusual for the wedge to become lodged in the split and it is then very difficult to either remove the wedge or to effect splitting of the log. When this happens, a second wedge is needed to open up the split further and to disengage the first wedge. Here again, this is a laborious, tedious, unsafe, time-consuming and innefficient operation. My invention also obviates these difficulties, since the jack means of my invention provide both splitting forces and, when the jack is reversed and removed from log contact, retraction forces can then be applied to log and post thereby removing the wedge block if such wedge removal should become necessary.

In addition, I have discovered a new and useful wedge for log splitting which is illustrated more specifically in FIG. 4. This wedge, shown in FIG. 4 mounted upon its base block for attachment to the jack post, comprises splitting edge *a-d*, a trapezoidal butt end with corners denoted *b-e-f-c*, a triangular top surface thereof forming triangle *a-e-f* and a bottom triangular surface thereof forming triangle *d-b-c*.

Wedge butt edge *b-c* is longer than butt edge *e-f*, and angle *b-d-c* is larger than angle *e-a-f*. In a preferred embodiment utilized in the examples which follow, edge *b-c* was 1.900 inches long, edge *e-f* was 0.600 inches long, and angles *b-d-c* and *e-a-f* were 28° and 8°, respectively. Planar surfaces *a-f-c* and *a-d-c* intersect at line *a-c*. Similarly, planar surfaces *a-e-b* and *a-d-b* intersect at line *a-b*. These two lines *a-b*, *a-c* of the oblique angle *b-a-c*, are referred to herein as the effort arms, since they are the main transmitting surfaces of the force of the wedge. The log to be split encounters two contact points of force along these effort arms, beginning at apex *a*, and continuing to widen as the log is pushed onto the wedge. As penetration continues, these contact points are moved further and further toward the outside diameter of the log, caused by the oblique plane of angle *b-a-c*, where parting resistance is at a minimum. Thus, during splitting, less and less force is required as parting proceeds. Hence, the further the wedge penetrates the log the less applied force is required.

When using such a wedge, I have discovered that for splitting wood which has been seasoned, the splitting occurs when wedge penetration is only about 2–4 inches into a typical 2-foot log, the splitting effort is surprisingly easy, and the log splits with an audible "snap".

While my invention has been disclosed herein in connection with certain embodiments and certain structural and procedural details, it is clear that changes, modifications or equivalents can be used by those skilled in the art. Accordingly, such changes within the principles of my invention are intended to be included within the scope of the claims below.

As examples of my invention in use, the following are further illustrative.

EXAMPLE 1

Seasoned logs, about 2 feet long, of fir, pine, maple, dogwood and poplar were split using the assembly shown in FIG. 1, using an automobile jack means and wedge block 2 illustrated in FIG. 4.

Wedge block 2 was constructed such that edge *b-c* was 1.900 inches long, edge *e-f* was 0.600 inches long, and angles *b-d-c* and *e-a-f* were 28° and 8°, respectfully. The height of the wedge, i.e. edge *a-d*, was 3.0 inches.

The pine and maple logs all split with about the same amount of force applied to the jack handle, which I approximate initially to be about ½ the force required to raise a car to change a tire. This force was required only for the initial penetration of the log. After about ½ inch of penetration into the logs, the force required to force the wedge through the log decreased rapidly up to the time of splitting of the log. Most logs cracked apart after about 2–3 inches of penetration.

The fir logs required approximately the same amount of force to split as the pine and maple logs, but the fibrous composition of the fir restricted the log from cracking open, and the wedge had to be moved through the log. This required minimal effort.

The poplar and dogwood logs were split effectively, but required slightly more force to be exerted upon the jack handle as compared to the pine and maple. The poplar cracked open after about 2–3 inches of penetration, while the dogwood resisted cracking due to several knots in the wood. The wedge had to be moved entirely through the dogwood to effect complete splitting.

EXAMPLE II

Wet, fresh wood was split as described in Example I. All logs resisted cracking, and required that the wedge be forced through the log completely to effect splitting.

Use of the wedge block shown in FIG. 2*b* together with the parting inserts shown as 7 in FIG. 2*b* had the advantageous effect of reducing the force required to split the wet wood.

Little or no differences could be determined between or among the different types of wood when splitting fresh, wet logs.

I claim:

1. A device for splitting logs comprising the following combination:
   a. jack means comprising a jack post and jacking mechanism; and
   b. a platform block mounted upon said jacking mechanism and attached thereto, said platform block having one face to contact one end of a log to be split; and
   c. a wedge block fixedly attached to said jack post having a wedge with apex facing said platform block in which said wedge apex forms an acute angle with said jack post, said acute angle opening toward said platform block, to prevent said log from disengaging at the wedge block during splitting, such that, when said log to be split is inserted with one end thereof contacting said platform block and the other end thereof contacting said apex of said wedge block, and said jack means are actuated forcing said platform block toward said wedge block, said log is split.

2. The device of claim 1 wherein said wedge block is provided with parting inserts.

3. A wedge for splitting wood having a cutting edge, a trapezoidal butt end having short and long bases, a top triangular face, a bottom triangular face, and four planar wedge surfaces, said top triangular face being generally parallel to said bottom triangular face and both triangular faces being perpendicular to said cutting edge and to said butt end, such that said bottom triangular face has as its base line said long base of said trapezoidal butt end and its apex at said cutting edge, and said top triangular face has as its base line said short base of said trapezoidal butt end and its apex at said cutting edge, said four planar wedge surfaces being defined as follows:
   a. by one side of said top triangular face and one side of said trapezoidal butt end;
   b. by the second side of said top triangular face and the second side of said trapezoidal butt end;
   c. by the cutting edge and one side of said bottom triangular face; and
   d. by the cutting edge and the second side of said bottom triangular surface.

* * * * *